United States Patent [19]

Mishcon et al.

[11] 4,024,733

[45] May 24, 1977

[54] MULTIPLE PATTERN WHEEL

[75] Inventors: Lester Mishcon; Harry Agulnek, both of Miami Beach, Fla.

[73] Assignee: The Singer Company, New York, N.Y.

[22] Filed: Feb. 20, 1976

[21] Appl. No.: 659,861

[52] U.S. Cl. ..... 66/50 A
[51] Int. Cl.² ..... D04B 15/76
[58] Field of Search ..... 66/50 A, 50 B

[56] References Cited

UNITED STATES PATENTS

| | | | |
|---|---|---|---|
| 2,025,463 | 12/1935 | Lombardi | 66/50 A |
| 3,170,312 | 2/1965 | Stock | 66/50 A |
| 3,354,671 | 11/1967 | Carroll | 66/50 A |

*Primary Examiner*—Louis K. Rimrodt
*Assistant Examiner*—A. M. Falik
*Attorney, Agent, or Firm*—Edward L. Bell; Robert E. Smith; William V. Ebs

[57] ABSTRACT

A circular knitting machine is provided with pattern wheels having jacks movable between needle actuating and non-actuating positions and with means for differently positioning the jacks in the wheels for each of a predetermined number of revolutions of the machine.

5 Claims, 9 Drawing Figures

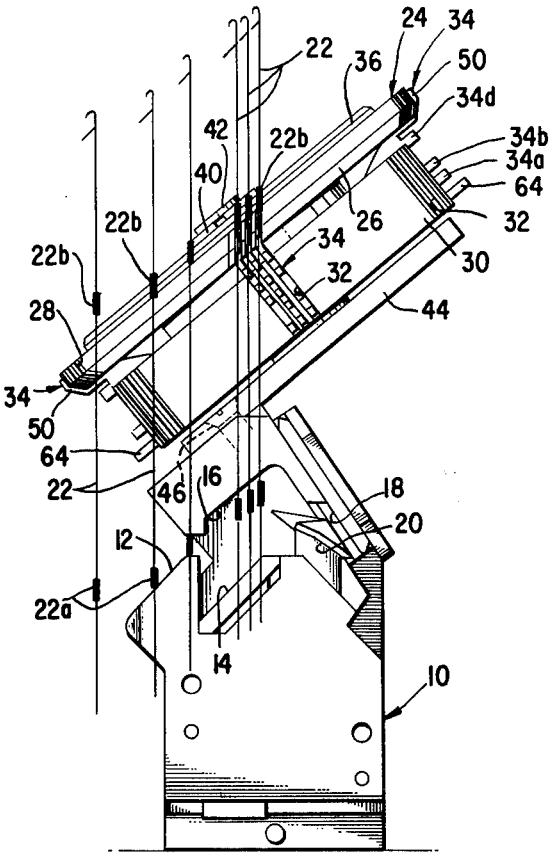
Fig. 1
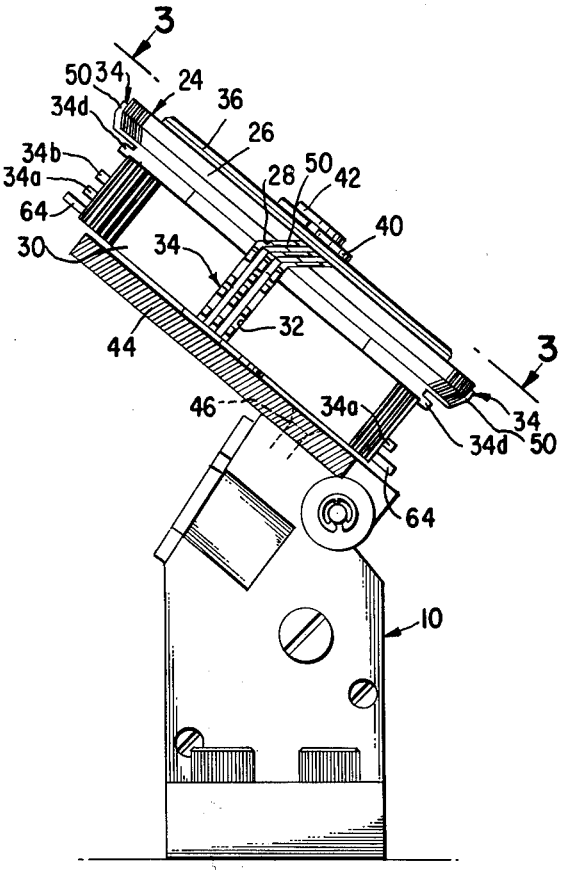
Fig. 2
Fig. 3
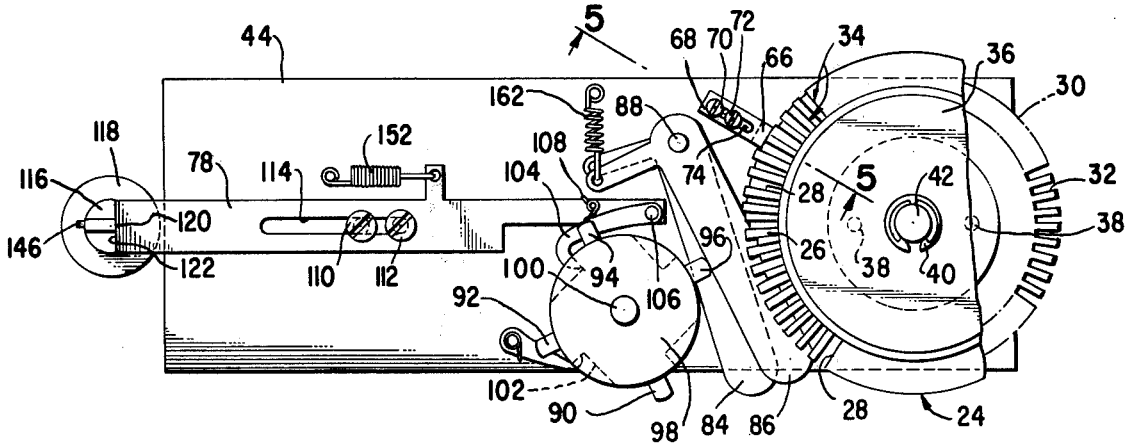

Fig. 6
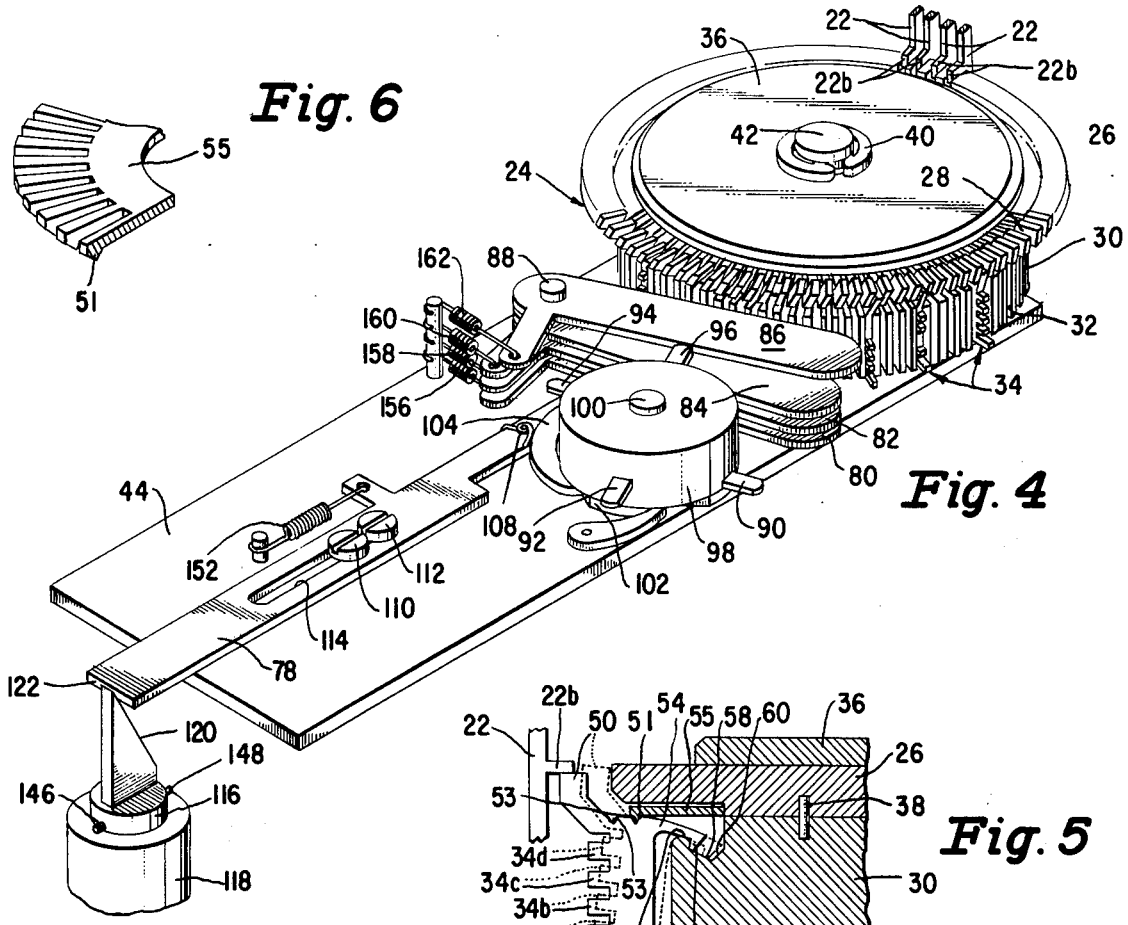
Fig. 4
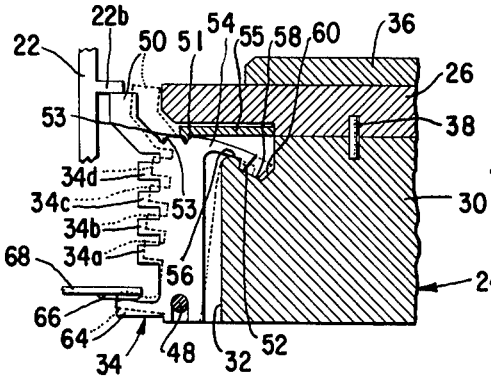
Fig. 5
Fig. 7
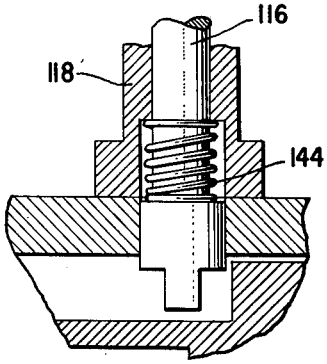
Fig. 9
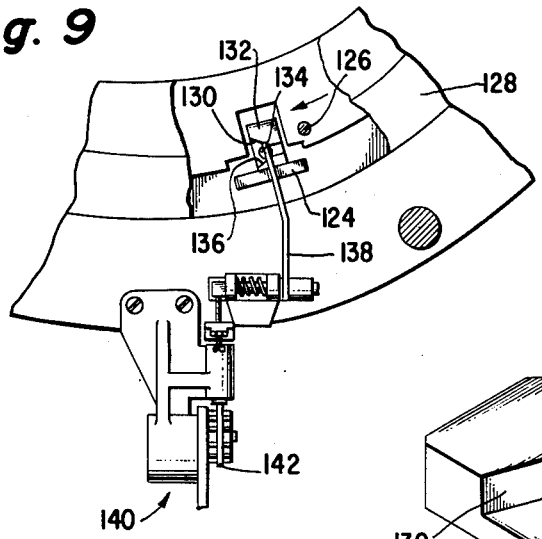
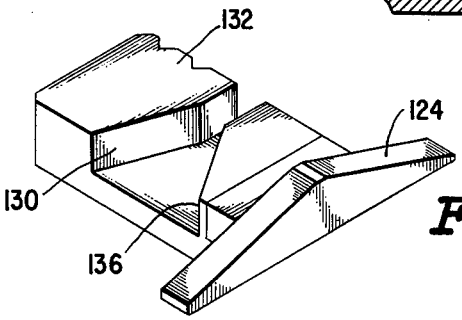
Fig. 8

MULTIPLE PATTERN WHEEL

BACKGROUND OF THE INVENTION

1. Field of the Invention

The invention relates to circular knitting machines and more particularly to circular knitting machines provided with pattern wheels at various feeds enabling the machine to produce a patterned fabric.

2. Description of the Prior Art

In conventional pattern wheel machines a course of patterned fabric is formed at each yarn feed (according to the positions of jacks in a pattern wheel at the feed) during each revolution of the machine. The jacks remain fixed during the operation of the machine and the pattern wheels influence the needles in the same manner during each and every revolution of the machine so that of necessity the pattern is repeated after each revolution. The number of courses produced during each revolution is equal to the number of yarn feeds on the machine and therefore the maximum number of courses over which a pattern may extend before being repeated is limited to the number of yarn feeds on the machine.

SUMMARY OF THE INVENTION

It is a prime object of the invention to increase the number of courses over which a pattern may extend in fabric produced on a pattern wheel machine. This is accomplished by rendering the pattern wheel jacks disposable in needle actuating and non-actuating positions, and controlling the positions of the jacks in a novel manner in timed relation to the operation of the machine. The jacks are uniquely constructed and include a set of butts at a plurality of levels, the butts of each set being on selected jacks only. An actuator for each set of butts operates to differently position the jacks for each of a predetermined number of revolutions of the machine.

DESCRIPTION OF THE DRAWINGS

FIG. 1 is an inside elevational view of a cam block having a pattern wheel according to the invention mounted thereon;

FIG. 2 is an outside elevational view showing the cam section block and pattern wheel of FIG. 1;

FIG. 3 is a view taken on the plane of the line 3—3 of FIG. 2 showing the pattern wheel and associated control mechanism;

FIG. 4 is an enlarged perspective view of the pattern wheel and associated control mechanism;

FIG. 5 is a fragmentary sectional view taken on the plane of the line 5—5 of FIG. 3.

FIG. 6 is a fragmentary perspective view showing a portion of a resilient disc associated with the pattern wheel;

FIG. 7 is a fragmentary sectional view of a plunger which is part of the control mechanism of FIGS. 3 and 4;

FIG. 8 is a perspective view of a cam for actuating the plunger of FIG. 6 and

FIG. 9 is a fragmentary plan view showing timing mechanism for controlling the cam of FIG. 8.

DESCRIPTION OF THE PREFERRED EMBODIMENT

Referring to the drawings, reference character 10 designates a cam section block for a circular knitting machine. As shown the cam section block supports a raise cam 12, adjustable placer cam 14, guard cam 16, stitch cam 18 and wing cam 20. Such cams are generally similar to those shown in U.S. Pat. Re. 28519 reissued Aug. 19, 1975, and serve like purposes. The cams are engageable with the lower butts **22*a* of two butt needles 22 having upper butts 22*b* which cooperate with a pattern wheel 24** constructed according to the invention.

Pattern wheel 24 includes a wheel disc 26 which is provided with angular slots 28, a jack retaining ring 30 under the wheel disc having slots 32 parallel to the axis of the wheel in each of which a jack 34 is retained, and a cover plate 36 over the wheel disc and of lesser diameter than the wheel disc. The wheel disc 26 and jack retaining ring 30 are pinned together at various locations such as at 38 and are held together with cover plate 36 by snap ring 40 as an assemblage rotatable on a shaft 42 which is affixed to a plate 44. In the assembled condition of the pattern wheel, upper ends of slots 32 in the jack retaining wheel 30 register with the lower ends of slots 28 in the wheel disc 26. Plate 44 is secured as at 46 to the cam section block 10. The position of shaft 42 on plate 44 and of plate 44 on cam section block 10 are such as to cause slots 32 to mesh with needles 22 and the pattern wheel 24 to be driven by the needles during rotation of the machine.

The jacks 34 are pivotally mounted on a ring 48 and are movable in slots 28 and 32 between an outer position (solid line position in FIG. 5) wherein a finger 50 is in position in slot 28 to engage and raise a needle butt **22*b*, and an inner position (dotted line position) in FIG. 5 wherein finger 50 is in position to permit a needle butt 22*b* to pass through the slot 28 without being raised. Mutually engaging ridges 51 and notches 53 on peripheral fingers 55 on a resilient metal or plastic disc and in the jacks 34 respectively hold the jacks in the needle actuating and non-actuating positions until displaced therefrom. Movement of the jacks 34 outwardly beyond their butt engageable position is prevented by the engagement of the tip of a tongue 54 on the jacks with the side surface 56 of an annular groove 58 in jack retaining ring 30, and movement of the jacks 34 inwardly beyond their butt missing position is prevented by the engagement of the tip 52 of tongue 54 with side surface 60 of annular groove 58**.

Each of the jacks 34 includes none, one, two, three, or all four of butts **34*a*, 34*b*, 34*c*, 34*d* shown in FIG. 5, the particular butts (number and location) being determined according to a pattern to be produced. Although the maximum number of butts on any jack is four in the pattern wheel of the drawings, such maximum number is a matter of design and may be more or less than four. It is convenient to produce jacks for the pattern wheel 24** from sheet metal, to stamp out each of the jacks with dies providing the maximum number of butts, and thereafter to break off selected butts from the jacks before inserting them in the pattern wheel.

Each of the jacks 34 is formed with a finger 64 which is subject to engagement by a cam 66 when the jack is in its needle butt missing position and the cam is in a jack actuating position. As shown cam 66 is located at the end of a member 68 which is slidably mounted on screws 70 and 72 that extend through a slot 74 in the member and are secured to plate 44. The member 68 may be manually positioned by an operator to dispose the cam in either a jack actuating position (illustrated position) or non-actuating position and the member may be secured in either of such positions by tightening screws 70 and 72. Engagement of the cam 66 with finger 64 while the cam is in the jack actuating position causes the jack to be tilted outward to its needle butt engaging position.

Butts 34*a*, 34*b*, 34*c*, and 34*d* of jacks 34 in the needle butt engageable position are subject to engagement by fingers 80, 82, 84 and 86 respectively and when engaged the jack on which the engaged butt is located is pivoted about ring 48 from the needle butt engaging position to the needle butt missing position. The fingers 80, 82, 84 and 86 are pivotally mounted on a post 88 and are actuable by tabs 90, 92, 94 and 96 respectively which are located 90° apart on a drum 98 that is rotatable on a shaft 100 affixed to plate 44. The drum 98 is affixed to a gear 102 which is engaged by a pawl 104 pivotally mounted 106 on the end of movable link 78, the pawl being biased into engagement with the gear by spring 108.

Movable link 78 is slidable on screws 110 and 112 which extend through a slot 114 in the link and are secured in plate 44. The link 78 is moved so as to cause gear 102 and drum 98 to be rotated through 90° upon vertical movement of a plunger 116 which is vertically slidable in a post 118 and has an inclined edge 120 in engagement with edge 122 of link 78. It is to be understood that a plurality of adjacent cam section blocks 10 including pattern wheel 24 and associated mechanism for controlling the position of jacks 34 in the wheel would be provided around the cylinder of a circular knitting machine, and that the associated jack controlling mechanism for each pattern wheel would include a plunger 116 as described. Each such plunger 116 would be actuable by a cam 124 that rotates with the cylinder of the machine, is similar to, and is controllable in like manner to the plunger operating cam of U.S. Pat. No. 2,543,121 of S. Mishcon et al for Knitting Machine issued Feb. 27, 1951.

During each revolution of the cam 124, a pin 126 mounted in a ring 128 having cam section blocks 10 mounted thereon, would be engaged by a camming surface 130 located on a sliding block 132 supporting the cam 124. The cam 124 is thereby moved to a radially inward position if not already in such position. The cam can then move past the plungers 116 in such radially inward position in which case there is no actuation of the plungers by the cam. The cam may, however, after being first moved radially inward by pin 126, be moved to a radially outward plunger actuating position by the action of another pin 134 on cam surface 136 of sliding block 132. Such pin 134 is carried on an arm 138 movements of which are controlled by mechanism 140 responsive to rotation of the cylinder and a timing chain 142 having links that predetermine whether the pin 134 is held in a position where it cannot engage cam surface 136 or is positioned to engage such cam surface and cause the cam to be moved to its radially outward position. When in its radially outward position cam 124 sequentially actuates plungers 116.

When a plunger 116 is actuated by cam 124, link 78 is moved as described hereinbefore, so as to cause gear 102 and drum 98 to be rotated through 90°. A plunger 116 after having been actuated by cam 124 is returned by spring 144 to an initial position wherein stops 146 and 148 engage plunger post 118. As the plunger is returned to its initial position, link 78 is returned from an actuated to unactuated position by spring 152. Each of springs 156, 158, 160 and 162 urge a finger 80, 82, 84 and 86 respectively into engagement with the surface 164 of drum 98 and return an associated finger, which has been held by a finger actuating tab against the pattern wheel 24, to the drum surface as the actuating tab moves off the finger.

The timing chain 142 may be provided with links causing cam 124 to be disposed in a plunger actuating position during each revolution of the machine. As a result, fingers 80, 82, 84 and 86 are positioned sequentially against the pattern wheel where each is maintained through one revolution of the wheel. After each of the fingers have been positioned and maintained against the pattern wheel for one revolution the operational sequence is repeated. As has been indicated whenever a finger 80, 82, 84 or 86 is positioned against the pattern wheel, cam 66 is also disposed to cause any jacks not in a needle butt engageable position to be moved into such position. It is thereby assured that each jack is in the needle butt engaging position before being disposed by rotation of the pattern wheel in a position where it may be influenced by an actuated finger. As jacks move by an actuated finger 80, 82, 84 or 86, those having a butt in alignment with the finger are moved from the needle butt engaging to needle butt missing position. Needle butts 22*b* each enter a pattern wheel slot 28 after the slot has moved beyond the jack actuating fingers and is raised or not depending upon whether or not there is a jack in a needle butt engaging position in the slot. Jacks in pattern wheels around the machine are selected during each revolution of the machine by a newly operated finger 80, 82, 84 or 86 in accordance with the disposition of jack butts in the various pattern wheels at the level of the actuated finger after which such operational sequence is repeated, and a repeating pattern having as many courses as there are feeds around the machine multiplied by the number of levels of butts on the pattern wheel jacks results in fabric produced on the machine. If it is desired to increase the pattern width by duplicating a design produced within the pattern as a result of the selection of jack butts at particular levels this is readily accomplished by providing the timing chain with links causing one or more of the fingers 80, 82, 84 or 86 to remain in a jack actuating position for more than one revolution of the machine.

If it is desired to continuously produce the same pattern during each revolution of the machine, jacks 34 with selected butts at only one level may be utilized in the pattern wheel 24. Such jacks may be disposed in needle butt engaging and non-engaging positions during one revolution of the machine after which the cam 66 may be disposed in a non-actuating position by suitably positioning and securing member 68 to avoid recurrent setting of the jacks in the wheel. The chain mechanism 140 may be disconnected to prevent the fingers 80, 82, 84 and 86 from operating or it may be maintained in operation. In either event the fingers will not affect the position of the jacks after having been set during the first revolution of the machine.

Numerous alterations of the structure herein disclosed will suggest themselves to those skilled in the art. However, it is to be understood that the present disclosure relates to a preferred embodiment of my invention which is for purposes of illustration only and not to be construed as a limitation of the invention. All such modifications which do not depart from the spirit of the invention are intended to be included within the scope of the appended claims.

We claim:

1. In a circular knitting machine the combination comprising a cam section block, needle actuating cams on the section block, a slotted pattern wheel, a plate affixed to the section block and having the pattern wheel rotatably mounted thereon above said cams, needles having an upper butt which enter the pattern wheel slots and drive the wheel and having a lower butt which engage said cams, jacks in the pattern wheel slots movable between a needle actuating and a non-actuating position, the jacks including a set of butts at each of a plurality of different levels and the butts of each set being on selected jacks only, means operable to preposition the jacks during rotation of the wheel, and an actuator for each set of butts mounted on said plate for movement relative to the pattern wheel and operable to change the positions of the jacks on which such butts are located prior to needles entering the slots wherein such jacks are located.

2. The combination of claim 1 including means operably connected to the actuators for controlling their operation in timed relation to the operation of the machine.

3. The combination of claim 1 wherein the prepositioning means is mounted on the plate and is manually movable between a jack engaging and a jack non-engaging position.

4. The combination of claim 1 including means mounted on said plate for selectively moving the actuators into positions against the pattern wheel and for holding an actuator which has been moved against the plate in such position for a predetermined period.

5. In a circular knitting machine the combination comprising a slotted pattern wheel, needles which enter the pattern wheels slots and drive the wheel, jacks in the pattern wheel slots movable between a needle actuating and non-actuating position, the jacks including a set of butts at each of a plurality of different levels and the butts of each set being on selected jacks only, means operable to preposition the jacks during rotation of the wheel, an actuator for each set of butts operable to change the positions of the jacks on which such butts are located prior to needles entering the slots wherein such jacks are located, and means for holding the jacks in their needle actuating and in their non-actuating positions including a disc of flexible material, the disc and jacks being mutually engageable in the said needle actuating and non-actuating positions in notches on one part and a ridge on the other.

* * * * *